United States Patent [19]

Momura

[11] 4,260,156

[45] Apr. 7, 1981

[54] TARGET APPARATUS FOR PINBALL MACHINES

[75] Inventor: Toshihiro J. Momura, Hollywood, Calif.

[73] Assignee: Kabushiki Kaisha Universal, Oyama, Japan

[21] Appl. No.: 110,911

[22] Filed: Jan. 10, 1980

[51] Int. Cl.[3] ..... A63B 71/00

[52] U.S. Cl. ..... 273/127 R

[58] Field of Search ..... 273/127 R, 127 B, 127 D, 273/118 A, 118 R, 119 A, 119 R, 120 A, 120 R, 121 A, 121 R, 122 A, 122 R, 123 A, 123 R, 124 A, 124 R, 125 A, 125 R, 127 C; 200/61.11

[56] References Cited

U.S. PATENT DOCUMENTS

| | | | |
|---|---|---|---|
| 1,799,241 | 4/1931 | MacCollom | 273/127 R |
| 1,998,153 | 4/1935 | Boland | 273/127 R |
| 2,289,690 | 7/1942 | Bakalyar | 273/127 R |
| 4,180,267 | 12/1979 | Harrop | 273/127 R |

*Primary Examiner*—Richard C. Pinkham
*Assistant Examiner*—T. Brown
*Attorney, Agent, or Firm*—Young & Thompson

[57] ABSTRACT

Target apparatus for pinball machines includes a plurality of longitudinally aligned targets disposed in a row on a downwardly inclined portion of the playing surface. Guides are disposed on both sides of the row of targets, to direct a ball up the incline into contact with the first target. The ball unseats the target, which is then pulled by a spring down through a hole in the playing surface. Thereafter the ball is free to contact the next target, and so on from target to target, the ball rolling back from the targets, on a trackway provided by the guides, under the influence of gravity. The retraction of each target actuates an electrical contact to change the score; and the targets can all be returned to their raised position by electrically operated mechanism.

5 Claims, 4 Drawing Figures

TARGET APPARATUS FOR PINBALL MACHINES

BACKGROUND OF THE INVENTION

The present invention relates to target apparatus for use in pinball machines, more particularly to such target apparatus in which a plurality of targets are arranged in spaced apart relationship in a row, with guides means on either side of the row to guide the ball into contact with the targets and to raise the ball from the playing surface of the pinball machine.

It is known to provide pinball machines with retractable targets on the playing surface. Such targets have an upper end that protrudes above the playing surface; and when a ball rolls against the target, the target retracts below the playing surface.

When a plurality of such targets are disposed in a row, there is of course a hole in the playing surface for the retraction of each target. The ball can accordingly strike targets subsequent to the first target, only by rolling over the holes corresponding to the targets that have previously been struck. As a result, the ball does not roll smoothly and sometimes stops on the hole of a retracted target.

OBJECTS OF THE INVENTION

It is accordingly a principal object of the present invention to provide target apparatus for pinball machines in which the path of the ball is not interrupted by the holes through which the targets are withdrawn.

Another object of the present invention is the provision of such apparatus, in which the position of the ball and the target relative to each other at the time of contact is precisely predetermined.

Finally, it is an object of the present invention to provide such apparatus, which will be relatively simple and inexpensive to manufacture, reliable in operation, and rugged and durable in use.

SUMMARY OF THE INVENTION

The above and other objects of the present invention are achieved by providing target apparatus for pinball machines, in which a plurality of targets are disposed in aligned relationship on an inclined playing surface of a pinball machine, there being a pair of guide members on opposite sides of the row of targets on which the ball can roll without contact with the playing surface. The guides flare outwardly at their lower ends that the ball initially enters, thereby to guide the ball between the guides and up onto the guides.

BRIEF DESCRIPTION OF THE DRAWINGS

These and other objects, features and advantages of the present invention will become apparent from a consideration of the following description, taken in connection with the accompanying drawing, in which.

DETAILED DESCRIPTION OF THE INVENTION

Figure 1:
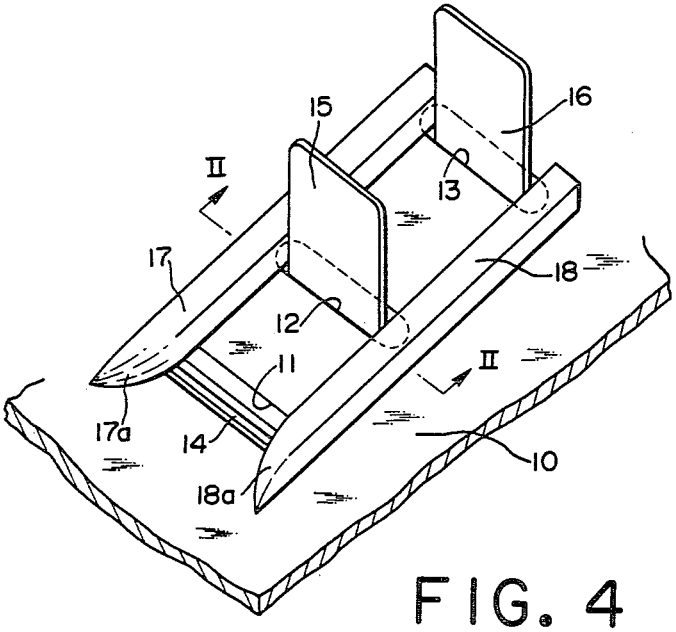
FIG. 1 is a fragmentary perspective view of a portion of target apparatus for a pinball machine, showing the present invention, the playing surface shown in FIG. 1 being downwardly inclined in a direction from the upper right of the figure toward the lower left of the figure.
Figure 2:
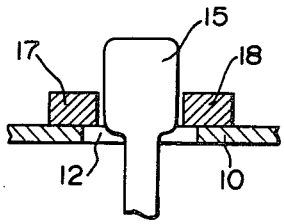
FIG. 2 is a fragmentary cross-sectional view taken on the line II—II of FIG. 1, showing a target in raised position.

Referring now to the drawing in greater detail, and first to FIG. 1 thereof, there is shown target apparatus for a pinball machine, supported on a playing surface 10 of the machine which is downwardly inclined from the upper right of FIG. 1 toward the lower left of FIG. 1. A longitudinally aligned series of holes 11, 12 and 13 are provided for receiving targets 14, 15 and 16, respectively. As will be seen from comparison of FIGS. 2 and 3, the targets are vertically extensible and retractable through the holes, from the extended position shown in the cases of targets 15 and 16 in FIG. 1 and FIG. 2, to the retracted position shown by the target 14 in FIG. 1 and the target 15 in FIG. 3.

Figure 3:
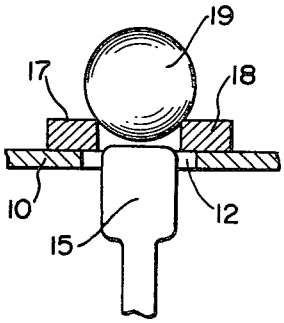
FIG. 3 is a view similar to FIG. 2 but showing the target in lowered position and a ball in juxtaposition therewith.

Elongated guide members 17 and 18 are disposed on opposite sides of the row of targets. The forward or lower ends 17*a* and 18*a* of guide members 17 and 18 definite guideways that flare outwardly in a downward direction, or inwardly in an upward direction, in order to enable a ball easily to enter between the guide members and to roll thereon in a position elevated above playing surface 10. Thus, as best seen in FIG. 3, the height of guide members 17 and 18 is such that a ball 19 rolling thereon, is spaced above playing surface 10 and so does not come into contact with the margins of the holes through that playing surface through which the targets vertically reciprocate.

In operation, the targets 14–16 are initially raised. When a ball 19 first rides onto guide members 17 and 18, in an upwardly inclined direction, it initially strikes target 14. Target 14 is thus pushed backward, that is, to the right in FIG. 4, within its hole 12, and is thus enabled to be retracted downwardly by a mechanism to be described hereinafter. The downward retraction of first target 14 causes a change in the score, as will also be described hereinafter.

If the momentum of ball 19 is spent by this contact with target 14, then ball 19 will roll back down from between guides members 17 and 18, under the influence of gravity and will be played again.

Let us say that the ball 19 is again impelled toward the upper right as seen in FIG. 1, by a kicker or flipper or the like in a manner well known in this art. If the ball again rolls between guide members 17 and 18, then it will on this second occasion strike the second target 15, which will again be retracted and again change the score. Upon a third such movement of the ball 19, the third target 16 may be struck and retracted.

On the other hand, if the ball 19 possesses sufficient momentum, it can strike and cause the retraction of more than one target during a single play of the ball. Therefore, it will be apparent that the operation of the device can be characterized by the successive retraction of the targets upon successive passages of the ball along the guide members 17 and 18, or by the sequential retraction of a plurality of the targets in the course of a single passage of the ball along the guide members 17 and 18.

Although the guide members 17 and 18 as shown in the drawing are of rectangular cross section, they may be circular or tubular or have any other shape which is suitable for supporting the ball 19 and keeping it spaced above the playing surface 10.

Figure 4:
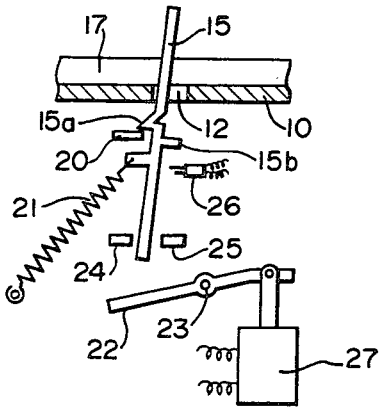
FIG. 4 is a schematic fragmentary side cross-sectional view showing the operating mechanism of an individual target.

Turning now to FIG. 4, there is shown a mechanism for moving the targets, e.g. target 15. Target 15 is provided with an engaging projection 15*a* which can engage with abutment 20 to support target 15 in raised position. A spring 21 continuously urges target 15 toward the lower left as seen in FIG. 4, to retract target 15 when 15*a* is not in contact with 20.

The target is raised to the FIG. 4 position, by energization of a solenoid 20, which swings a lever 22 clockwise about a pivot 23, thereby to push up the lower end of target 15 between positioning members 24 and 25, until projection 15*a* clicks past abutment 20 and comes to rest on the upper surface thereof. Of course, the energization of solenoid 20 is time controlled by conventional means (not shown), so that lever 22 swings back to the FIG. 4 position after it has performed its task.

When ball 19 strikes target 15, projection 15*a* is moved off to the right, out of engagement with abutment 20, whereupon spring 21 withdraws target 15 to the FIG. 3 position. During this downward movement, projection 15*b* strikes switch 26, which produces the signal by which the change in score is registered, again by conventional means which need not be illustrated.

From a consideration of the foregoing disclosure, therefore, it will be evident that the initially recited objects of the present invention have been achieved.

Although the present invention has been described and illustrated in connection with a preferred embodiment, it is to be understood that modifications and variations may be restored to without departing from the spirit of the invention, as those skilled in this art will readily understand. Such modifications and variations are considered to be within the purview and scope of the present invention as defined by the appended claims.

What is claimed is:

1. Target apparatus for pinball machines having an inclined playing surface, comprising a plurality of holes extending through said playing surface, said holes being aligned in a row whose one end is higher than its other end, a target in each said hole, each said target being upwardly extensible and downwardly retractable through its associated said hole, means to retract each said target through its associated hole upon the impact of a ball with the target, and guide means disposed at each side of and parallel to said row, said guide means supporting a said ball thereon spaced a distance above said playing surface.

2. Apparatus as claimed in claim 1, said guide means having at the lower end of said row downwardly outwardly inclined portions for guiding a said ball onto said guide means.

3. Apparatus as claimed in claim 1, said guide means comprising elongated guide members supported on said playing surface.

4. Apparatus as claimed in claim 3, said guide members at a distance from their lower ends having rectangular cross-sectional configurations.

5. Apparatus as claimed in claim 3, said guide members at the lower ends of said row having rounded surfaces that converge in the direction of movement of a ball from below between said guide members, and rounded surfaces upon which a said ball progressively rides up onto said guide members when entering between said guide members from below.

* * * * *